United States Patent [19]

McCormick

[11] Patent Number: 4,717,351

[45] Date of Patent: Jan. 5, 1988

[54] REDUNDANT ELECTRICAL CONNECTOR RELEASE

[75] Inventor: Larry L. McCormick, Los Angeles, Calif.

[73] Assignee: G & H Technology, Inc., Santa Monica, Calif.

[21] Appl. No.: 896,873

[22] Filed: Aug. 15, 1986

[51] Int. Cl.[4] ..... H01R 13/629

[52] U.S. Cl. ..... 439/153

[58] Field of Search ..... 339/45 R, 45 M; 285/33, 285/34, 35, 315, 316; 439/152–160

[56] References Cited

U.S. PATENT DOCUMENTS

| | | | |
|---|---|---|---|
| 3,336,562 | 8/1967 | McCormick et al. | 439/258 |
| 3,409,045 | 11/1968 | Mackey et al. | 285/316 |
| 3,430,184 | 2/1969 | Acord | 339/45 M |
| 3,509,515 | 4/1970 | Acord | 439/258 |
| 3,594,694 | 7/1971 | Clark | 339/45 M |
| 4,265,503 | 5/1981 | Baur | 339/45 M |
| 4,605,271 | 8/1986 | Burns | 339/45 M |

*Primary Examiner*—John McQuade

*Attorney, Agent, or Firm*—George J. Netter

[57] ABSTRACT

One connector part has an outer locking shell spring-loaded to move axially and with an interior circumferential cavity which can be aligned with locking fingers when the locking shell is subjected to a predetermined amount of separating force enabling the locking fingers to be released. The other connector part is spring-loaded to hold further locking fingers in contacting relation to an outer surface of the connector shell. When an axial force applied to mated connector parts exceeds the first predetermined releasing force and connector release has not been achieved then the spring-loaded other connector part allows its fingers to extend beyond the innermost end of that connector part releasing the fingers from locking engagement and, therefore, releasing the connector parts.

7 Claims, 6 Drawing Figures

READY TO MATE

MATED (LANYARD RELAXED)

NORMAL SEPARATION

REDUNDANT SEPARATION

REDUNDANT ELECTRICAL CONNECTOR RELEASE

The present invention relates to releasable electrical connectors, and, more particularly, to a redundant release for such connectors which are designed to be separable in the event of being subjected to forces along a predetermined direction exceeding a certain maximum.

BACKGROUND OF THE INVENTION

An electrical connector which has found wide use for some time is a plug and receptacle connector having parts releasably fit together so as to interconnect one or more pairs of electrical cable wires. More particularly, the connector parts each include electrical contacts (e.g., pin contacts in one and socket contacts in the other), which fit together to establish the electrical connection on mating of the connector parts.

There are many situations in which it is desirable to be able to quickly unmate a connector in order to protect equipment connected to the cables. For example, one end of the cable may be connected to relatively expensive and sensitive equipment and in the event of high interference signals being impressed upon or induced into the other end of the cable, it may be desirable to quickly release an intervening connector in order to prevent damaging the equipment.

There are other situations in which due to relative inaccessibility of the electrical connector, mechanical release means are useful. For example, in the event the connector is located at a relatively high overhead location, or possibly between two relatively immovable objects, the ability to release the connector parts by manipulation of a cable, lever or the like is desirable and may be imperative in the case of an emergency. In yet other situations, it may be absolutely necessary to separate an electrical cable from associated equipment (e.g., release of a space capsule) where failure to do so may cause such extraordinary harm or be so expensive or dangerous to equipment and persons that there may be provided a first form of connector release which is actuated when a predetermined force is applied along a separating direction and a further and distinct separating means is provided to separate the electrical parts in the event that the first separating means is inoperative for some reason. This second separating means, which customarily is made operative at a higher separating force than the first separating means, is sometimes referred to as a redundant release.

An excellent quick disconnect electrical connector is that described in U.S. Pat. No. 4,605,271 by Edgar Burns, assigned to the same assignee as the present application. Although found excellent in all normal circumstances of use, this connector does not have a redundant or additional means for releasing the connector, and it is possible, depending upon a twisting or bending relative movement between the connector parts, that they could be hung up and not capable of being released.

OBJECTS AND SUMMARY OF THE INVENTION

It is a primary object and aim of the present invention to provide an improved release means for an electrical connector which is mated and unmated along a predetermined straight line path.

Another object of the invention is the provision in a releasable connector of means for releasing the connector parts when they are subjected to an axial force above a first predetermined maximum and second redundant release means actuated upon the application of additional force.

In the practice of the described invention there is provided an electrical connector consisting of plug and receptacle parts, which are joined together and released by moving the connector parts toward and away from each other along a straight-line path. The connector parts each include a metal shell and unitary collet with a plurality of tines or fingers extending axially toward the other connector part during mating, and which fingers are aligned with respective corresponding tines on the other connector part during proper mating of the connector. The outer end portions of the aligned corresponding tines include a set of formed surfaces which can interfit with one another to establish locking when closely held together.

One of the connector parts includes an outer locking shell which is spring-loaded to move axially of the shell and has an interior circumferential cavity which can be aligned with the interlocked fingers of the mated connector when the locking shell is subjected to a predetermined or greater amount of axial force, thereby enabling the force to be applied in a manner to release the tines, and thus the connector parts. The other connector part collet is spring-loaded so as to hold its locking fingers in retracted position or in contacting relation to the outer surface of the connector shell. When an axially applied force exceeds the first predetermined releasing force and connector release has not been achieved, then the spring-loaded collet of this other connector part allows the fingers to extend beyond the innermost end of the connector part shell, thereby enabling release of the fingers from locking engagement and, therefore, release the connector parts.

DESCRIPTION OF A PREFERRED EMBODIMENT

Figure 1:
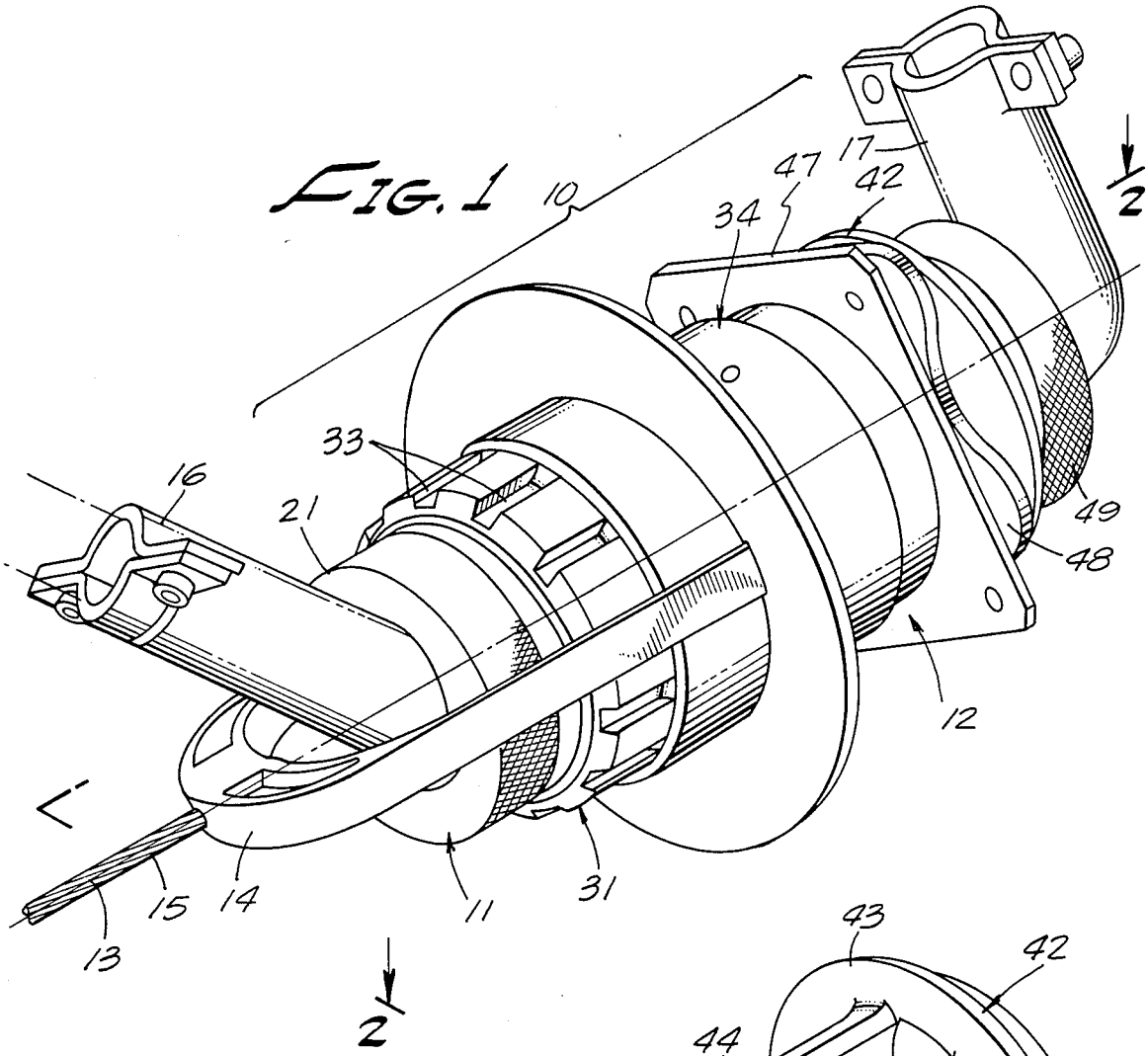
FIG. 1 is a perspective view of a releasable electrical connector, including the redundant release means of the present invention.

With reference now to the drawings, and particularly FIG. 1, the electrical connector to be described is enumerated generally as 10 and includes in its major components a plug connector part 11, a receptacle connector part 12, which connector parts are releasably joined by moving the parts towards each other along the axis line indicated as 13. A U-shaped force application member 14 has its ends affixed to the plug connector outer surface and includes a lanyard 15 connected therewith such that when a separating force of sufficiently high amount is applied to the lanyard 15, the connector parts can be pulled apart through the operation of means to be described. Electrical cable wires introduced into the plug connector part 11 via a back shell 16 and a corresponding set of cable wires to be interconnected with those of the plug are introduced via back shell 17 into the receptacle.

Figure 2:
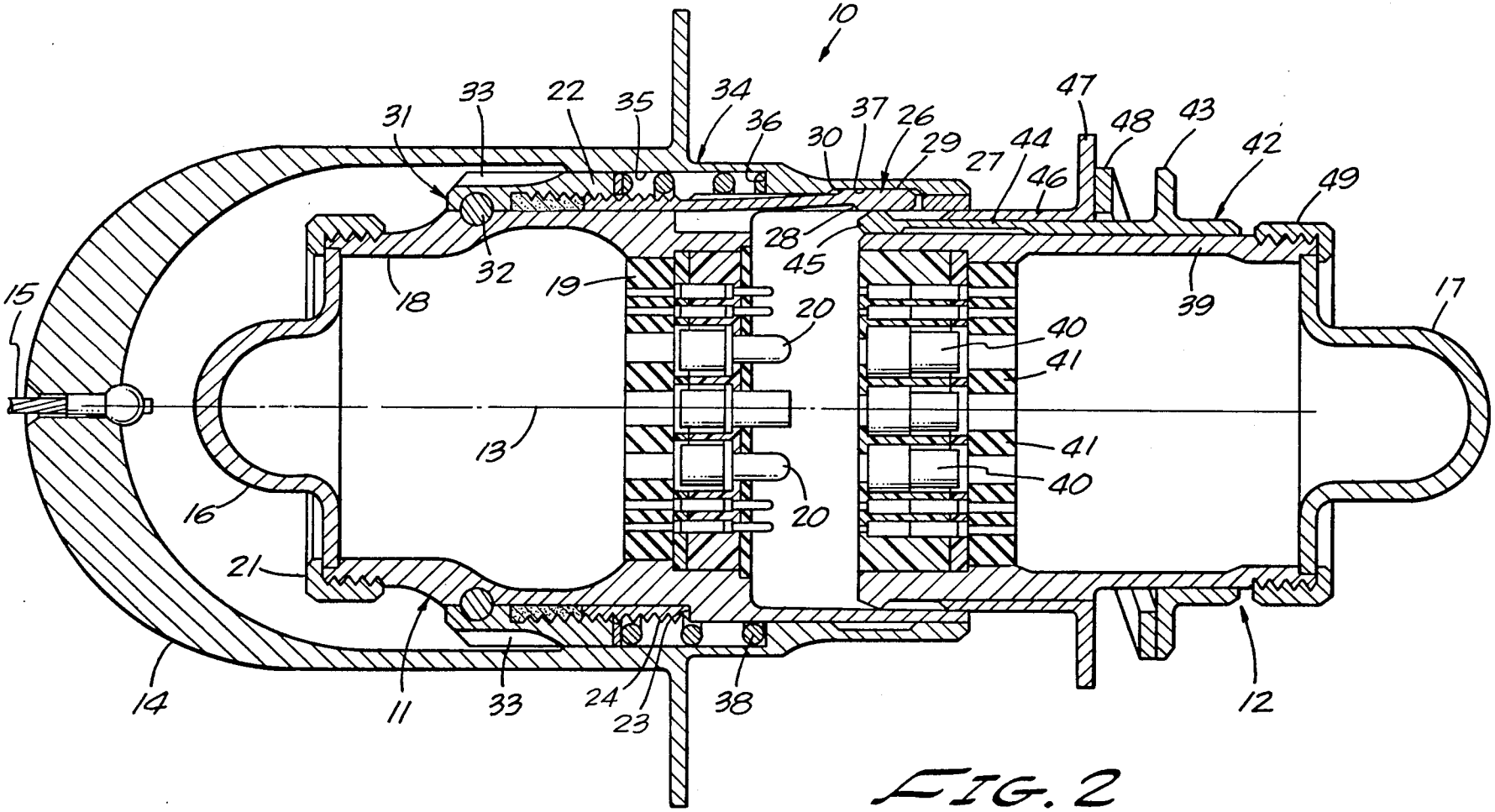
FIG. 2 is a side elevational sectional view of the connector of FIG. 1, taken along the line 2—2 thereof.

Turning now additionally to FIG. 2, it is seen that the plug 11 includes a generally cylindrical metal shell 18 within which conventional insulating inserts 19 are mounted for carrying pin contacts 20 to be interconnected to cable wires (not shown) entering via the back shell 16. An end cap 21 is threaded unto the outermost end of the shell 18 to secure the back shell 16 thereon.

Figure 6:
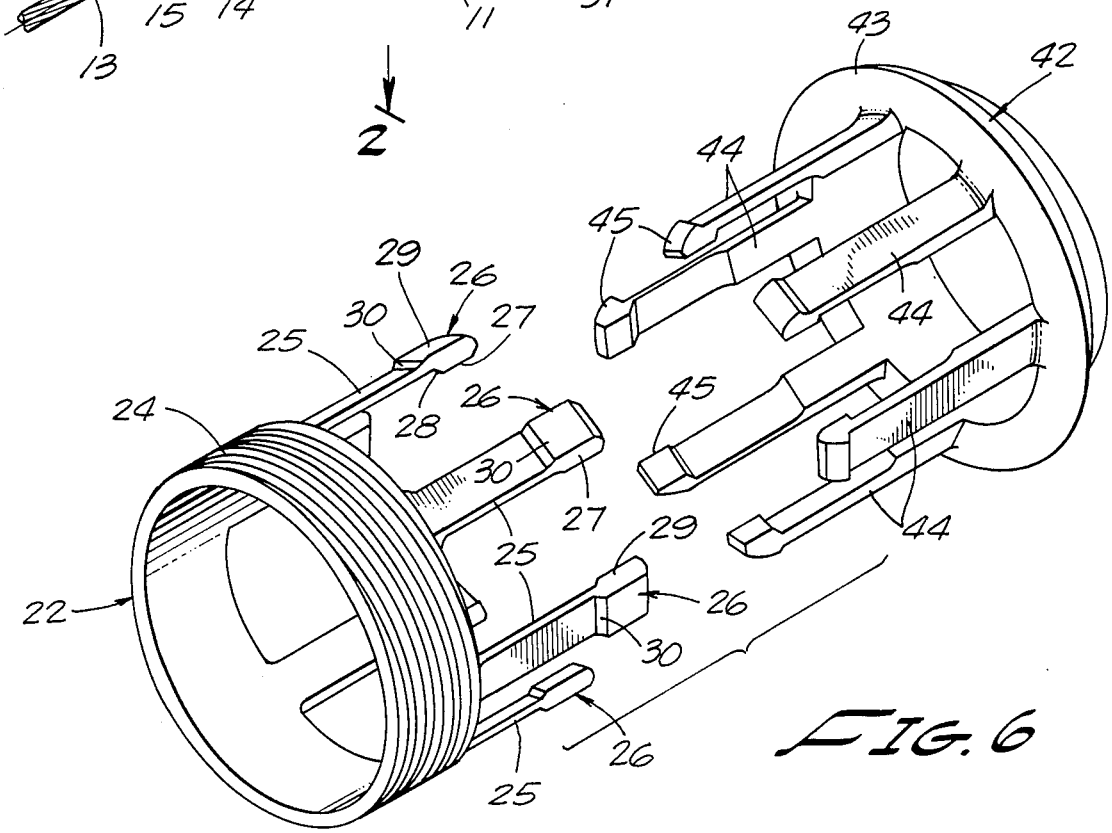
FIG. 6 is a perspective view of the collets with locking fingers shown removed from the connector and in aligned condition that would be assumed prior to mating of the connectors.

A cylindrical collet 22 (see FIG. 6 also) has a smooth interior surface which is received upon and over the shell 18, with portions thereof abutting against a shoulder 23 preventing movement of the collet off the shell 18 at the pin socket end. The outer surface of the collet 22 is provided with a set of threads 24 for a purpose to be described.

Collet wall parts extend longitudinally therefrom to form a plurality of tines or fingers 25, which include at their outer ends radially outwardly and inwardly directed portions forming locking means 26 for coacting with similar such means with the receptacle to be described. More, particularly, on the inwardly directed surface of the end portion 26 there is a radially inwardly thickened portion 27 with a shoulder 28 which faces towards the collet, and a similarly thickened portion 29 on the opposite side of the finger has a shoulder 30. As can be seen best in FIG. 2, the locking end portions 26 of the fingers 25 extend substantially beyond the outermost end of the shell 18, as well as any of the contacts 20 mounted therein.

A nut 31 has internally threaded portions permitting receipt upon the collet 22 and also includes a ring 32 which is received in similar dimensioned grooves on the internal surface of the nut, as well as on the external surface of the shell 18, which construction enables rotation of the nut 31 about the axis of the plug shell 18 for threading receipt onto the collet. A set of external grooves 33 on nut 31 (FIG. 1) enable use of a spanner wrench (not shown) for adjusting the nut as desired.

A locking shell 34 has a first interior bore 35, which can be slidingly received over the outer surface of the nut 31 and which terminates at its inner end in a shoulder 36. Outwardly of the shoulder 36 there is a further circumferentially and inwardly directed groove 37 having a width slightly greater than that of the collet finger locking end portion 26. A coil spring 38 is located within the space between the shoulder 36 of the locking ring 34 and the outer end surface of the nut 31, thereby resiliently urging the two axially apart.

The U-shaped arm 14 has its ends affixed to the locking ring 34 and includes a lanyard 15 interconnected therewith such that pulling action on the lanyard will tend to move the locking ring against the coil spring 38 or closer towards the nut 31. When the lanyard is relaxed and the coil spring extends the locking ring away from the nut 31, the internal groove 37 thereof lies immediately opposite the finger end portions 30 such that any radial movement of the collet finger end portions 30 will cause them to be located within the groove 37, as shown in FIG. 2, for example.

The receptacle 12 includes a metal shell 39 having a set of conventional socket contacts 40 mounted within insulating inserts 41 in a manner well known in the electrical connector art. The socket contacts 40 are so arranged that they are respectively aligned with and can be mated with the pin contacts 20 upon mating of the connector parts 11 and 12.

Figure 3:
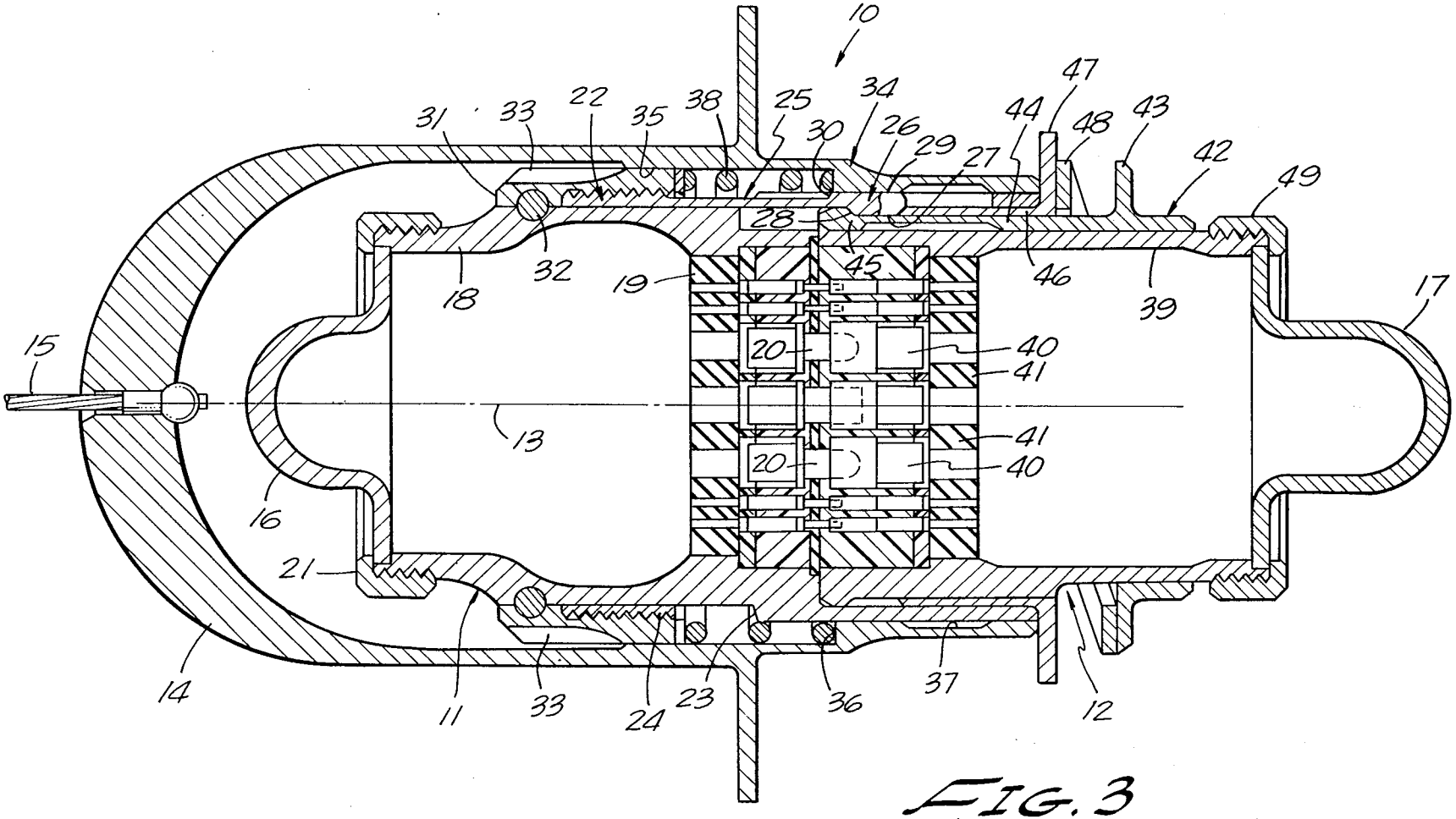
FIG. 3 is a sectional view similar to FIG. 2, showing the connector fully mated and no releasing force applied.

A cylindrical metal collet 42 has a radially outwardly extending circumferential flange 43 and a set of tines or fingers 44 terminating in locking end portions 45. By comparing FIG. 6 and FIG. 2, it can be seen that the end portions 45 of the collet fingers 44 are so dimensioned as to permit fitting inside the collet fingers 25 of the plug connector part and when they are so aligned will move the end portions 26 of the collet fingers slightly outwardly bringing the locking heads 45 into locking engagement with the locking head 26 (FIG. 3). A further shell 46 is integral with the receptacle shell 39 at a plurality of points about the circumference of the receptacle shell and includes integral therwith a radially outwardly extending flange 47. In assembly, the collet fingers 44 are located between the shell 46 and the receptacle shell 39, with a wavy washer spring 48 urging the two flanges 43 and 47 axially apart. The outer end of the receptacle 12 is enclosed by a nut 49 to secure the back shell parts 17 thereto.

Reference is now made to FIG. 2 for the ensuing description of connector mating. Receptacle 12 is moved axially into the open end of the plug 11 while a sufficient force is applied to the lanyard to position the finger locking end portion 26 directly opposite groove 37 in shell 34. The receptacle collet finger end portions 45 will engage the inner surfaces of the plug collet finger end portions 26 moving them into groove 37. Further axial movement of the receptacle and plug toward one another allows the pin contacts 20 to be fully received into corresponding socket contacts 40, at which time the collet finger end portions 26 and 45 lockingly engage one another with respective shoulders abutting one another as shown in FIG. 3. Relaxing the lanyard 15 allows the spring 38 to drive shell 34 away from nut 31 locating groove 37 beyond the collet finger end portion 26. Accordingly, the collet finger end portions are locked together, which also locks the plug and receptacle together.

Figure 4:
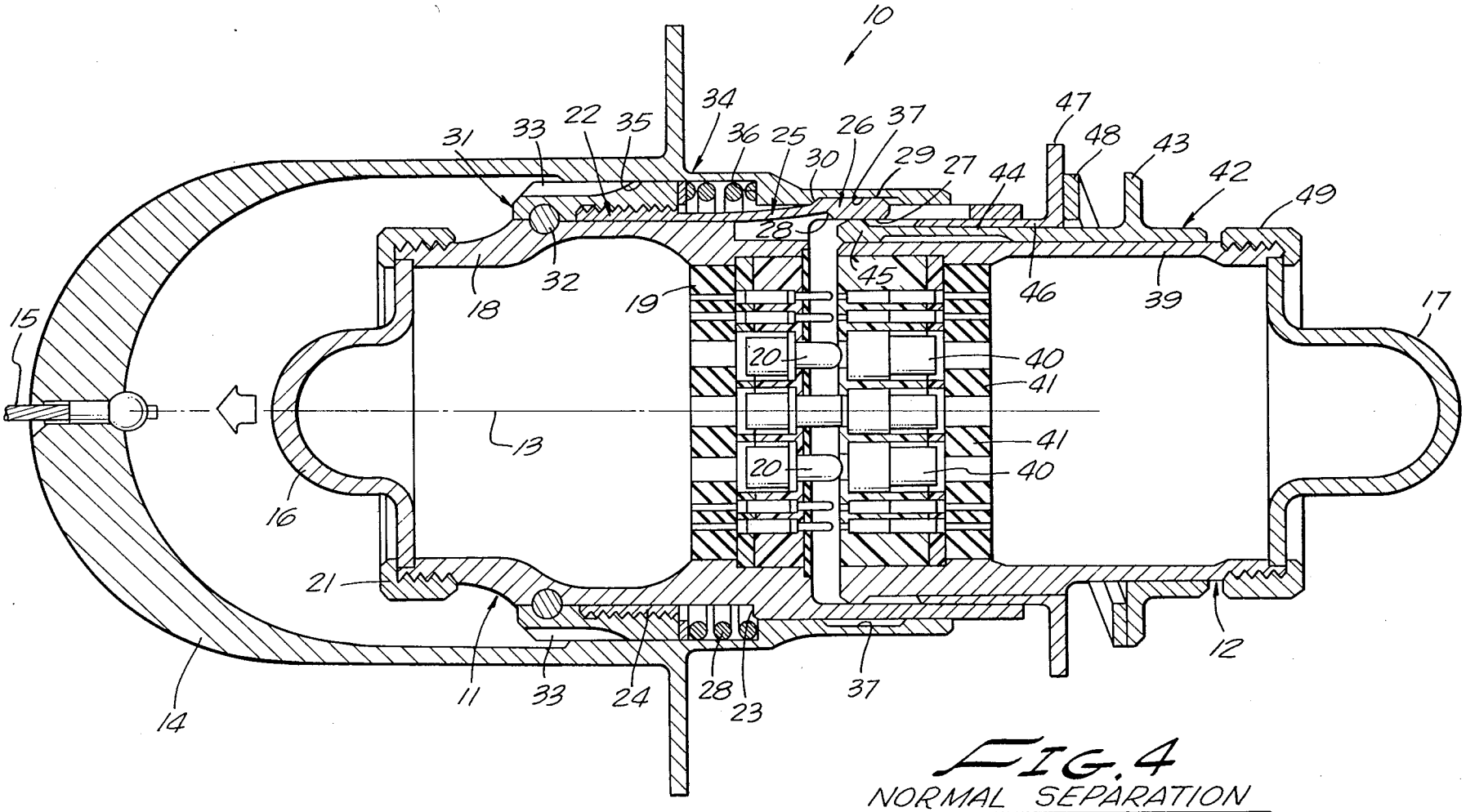
FIG. 4 is a sectional view similar to FIGS. 2 and 3, showing the connector during normal separation.

For normal separation of the connector, a pulling force is applied to lanyard 15 while retaining the receptacle (FIG. 4). The lanyard pull compresses spring 38 and locates groove 37 opposite collet finger end portions 26 which provides a space within which the portions 26 can move and, in that way, allows the connector to separate.

Figure 5:
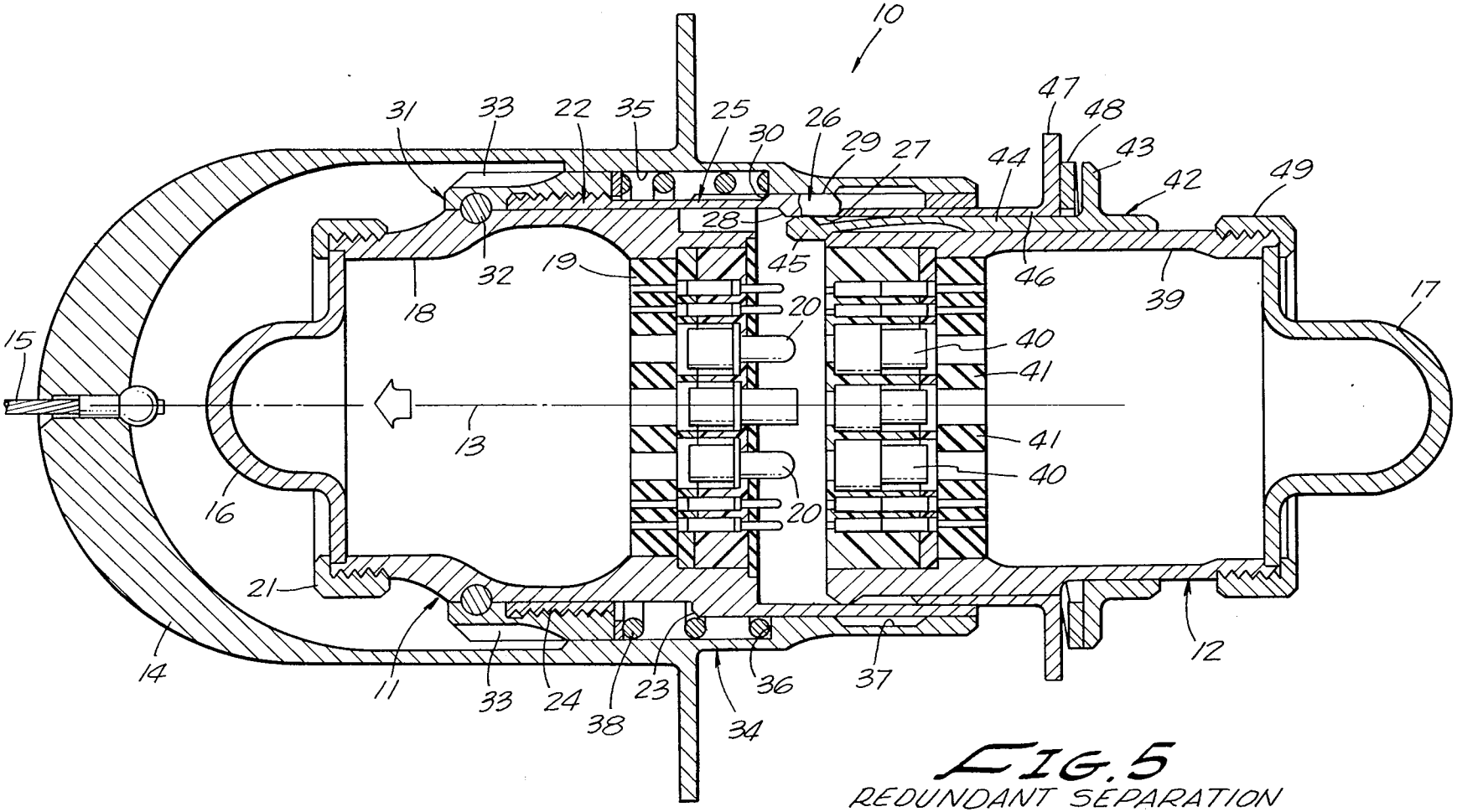
FIG. 5 is a still further side elevational sectional view similar to FIGS. 2–4, showing the connector during redundant separation.

It may be that normal separation cannot, for one reason or another, be accomplished, and that pulling on the lanyard is unable to move the shell 34 groove 37 to the release position. When this occurs, then the described redundant release means is called into play. Turning now to FIG. 5, it is assumed that a separating force has been applied to the connector (arrow) and that the plug collet finger end portions are not released into the groove 37. Further pulling force application pulls the receptacle collet 42 toward plug compressing the spring 48 between flanges 43 and 47. This movement continues until the receptacle collet finger end portions 45 extend beyond the end of the receptacle shell 39, which releases the collet fingers'locking engagement and enables connector separation.

What is claimed is:

1. An electrical connector including plug and receptacle parts mated and unmated by relative movement along an axis, comprising:

releasable locking means interrelating mated plug and receptacle parts, said locking means including a plurality of fingers extending from each connector part, said fingers on the plug part being alignable with corresponding fingers on the receptacle part and enlarged end portions of the aligned fingers interlocking together on connector mating;

first spring-loaded means for releasing the locking means when a separating force exceeding a first predetermined minimum is applied to the connector; and second spring-loaded means for releasing the locking means when a separating force exceeding a second predetermined minimum greater then the first predetermined minimum is applied to the connector.

2. An electrical connector as in claim 1, in which the plug and receptacle part fingers are each unitarily related to respectively separate collects, said collets being respectively mounted onto the plug and receptacle connector parts.

3. An electrical connector as in claim 2, in which there is provided an open-ended shell received on the plug part and plug collet, the first spring-loaded means including first spring means contacting the shell and plug part urging the shell to a first extension with respect to the plug part and compressible to locate the shell at a second extension less than the first extension, said shell including an internal circumferential groove which is aligned with the fingers enlarged end portions at the second extension and a smooth inner surface of the shell of lesser diameter than that of the groove engaging the fingers enlarged portion at the shell first extension; the receptacle part collet being slidingly received on the receptacle part, and the second spring-loaded means including second spring means resiliently urging the collet to a first position locating the collet finger enlarged end portions in contact with the receptacle part outer surface compressible to a second position locating the finger enlarged portions off the receptacle part outer surface.

4. An electrical connector as in claim 3, in which the second spring means requires a greater force to compress it than does the first spring means.

5. An electrical connector as in claim 3, in which a U-shaped arm is secured to the shell for applying separating force to the connector.

6. An electrical connector as in claim 3, in which the receptacle part collet includes a flange, and the second spring means reactively interrelates the collet flange and a further flange on the receptacle part.

7. An electrical connector as in claim 6, in which the second spring means consists of a wavy washer.

* * * * *